US006263710B1

(12) United States Patent
Harris

(10) Patent No.: US 6,263,710 B1
(45) **Date of Patent: *Jul. 24, 2001**

(54) ANTI-ABDUCTION DEVICE

(75) Inventor: Christopher L. Harris, Raleigh, NC (US)

(73) Assignee: Protective Solutions, L.L.C., Raleigh, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/448,710

(22) Filed: Nov. 24, 1999

Related U.S. Application Data

(63) Continuation-in-part of application No. 09/185,314, filed on Nov. 3, 1998, now Pat. No. 5,996,380.

(51) Int. Cl.[7] ..... E05B 75/00

(52) U.S. Cl. ..... 70/16; 128/878; 119/856; 473/212

(58) Field of Search ..... 70/16; 24/16 PB; 128/878, 879; 473/212, 213, 447, 448, 450; 602/16, 21, 63; 119/770, 792, 810, 811, 856, 857

(56) References Cited

U.S. PATENT DOCUMENTS 5,996,380 * 12/1999 Harris ..... 70/16

* cited by examiner

*Primary Examiner*—Suzanne Dino Barrett
(74) *Attorney, Agent, or Firm*—Coats & Bennett, P.L.L.C.

(57) ABSTRACT

An anti-abduction device for preventing or discouraging the unlawful abduction of a child or person. The anti-abduction device comprises a pair of bracelets with each bracelet being adapted to fit around the arm of a person. More particularly, the bracelets include an interconnecting structure that enables the bracelets to be interconnected. In use the bracelets are disposed about the arms of a child or person. In an abduction threat the child or person places his or her arms around an object. Because the bracelets assume an interconnected mode after the arms have been extended around the object, it follows that the child or person is effectively tied to the object and this will serve to frustrate the abduction attempt.

23 Claims, 9 Drawing Sheets

ANTI-ABDUCTION DEVICE

CROSS REFERENCE TO RELATED APPLICATION

The present application is a continuation-in-part application of U.S. patent application Ser. No. 09/185,314, filed Nov. 3, 1998 now U.S. Pat. No. 5,996,380.

FIELD OF THE INVENTION

The present invention relates to anti-abduction devices and more particularly to an anti-abduction device of the type that includes two interconnected bracelets that are worn by a child or other person.

BACKGROUND OF THE INVENTION

Children in this country and throughout the world are being unlawfully abducted at an increasing rate. This, of course, is a most serious problem because in the end, abducted children, if they survive, are often scarred for life. Unfortunately, the problem of protecting children from abduction has been with us a long time and is a very difficult problem to solve. There have been attempts by others to devise various devices that are aimed at preventing or inhibiting the abduction of children. One type of device is a leash mechanism that is worn by the child and which extends from the child to where it is tied to a parent or other adult. This obviously requires the child be effectively tied to the parent or adult on a continuing basis. This can be unduly restrictive for both the parent and the child. In any event and for whatever reason, these leash type devices have not met with any substantial commercial success.

Experts on child abduction tell us that the first ten seconds of an attempted child abduction is a very critical time period. That is, if some obstacle can be interposed in the abduction attempt during the first ten seconds, then in many cases the criminal attempting the abduction will be frustrated and will flee the scene so as to avoid being caught. With this in mind, the present invention addresses the child abduction problem by attempting to frustrate the abduction attempt within the first ten seconds or within the initial period of the abduction attempt.

SUMMARY OF THE INVENTION

The present invention entails an anti-abduction device that is designed to be used by children and other persons that might be the target of an abduction attempt. The device of the present invention comprises two arms bracelets, with each bracelet being adapted to fit and be worn about the arm of a child or other person. Incorporated into the structure of the bracelets is an interconnecting structure. That is the two bracelets are interconnected or can be easily and quickly interlocked. In the way of an example, the anti-abduction device of the present invention comprises two arm bracelets that are interconnected by one or more cables. The bracelets are designed to be secured together and worn on a single arm. However, in the case of an abduction attempt, one bracelet is readily separable from the other and once separated each bracelet encompasses a separate arm while the interconnecting cable effectively ties the two bracelets together.

In the embodiment disclosed herein, the two bracelets are typically worn on one arm. In the event of an abduction attempt the child or other person will look for an object such as a lamp pole, tree, etc. Once a reachable object has been identified, the child will extent his or her arms around the object and will then transfer one of the two bracelets to the other arm and because the bracelets are interconnected via cables, the child becomes effectively tied to the object. Accordingly, the abduction attempt can be frustrated, and if only momentarily, that may be sufficient to spoil the abduction attempt.

It is therefore an object of the present invention to provide an anti-abduction device for use by a child or other person that will frustrate an abduction attempt and will tend to cause the criminal attempting to perpetrate the crime to flee the scene.

Other objects and advantages of the present invention will become apparent and obvious from a study of the following description and the accompanying drawings which are merely illustrative of such invention.

BRIEF DESCRIPTION OF THE DRAWINGS

FIG. 12 is a fragmentary exploded view of portions of the anti-abduction device shown in FIGS. 10 and 11 and particularly illustrating how the flexible line or cable is wound around a portion of the spindle.

DETAILED DESCRIPTION OF THE INVENTION

Figure 1:
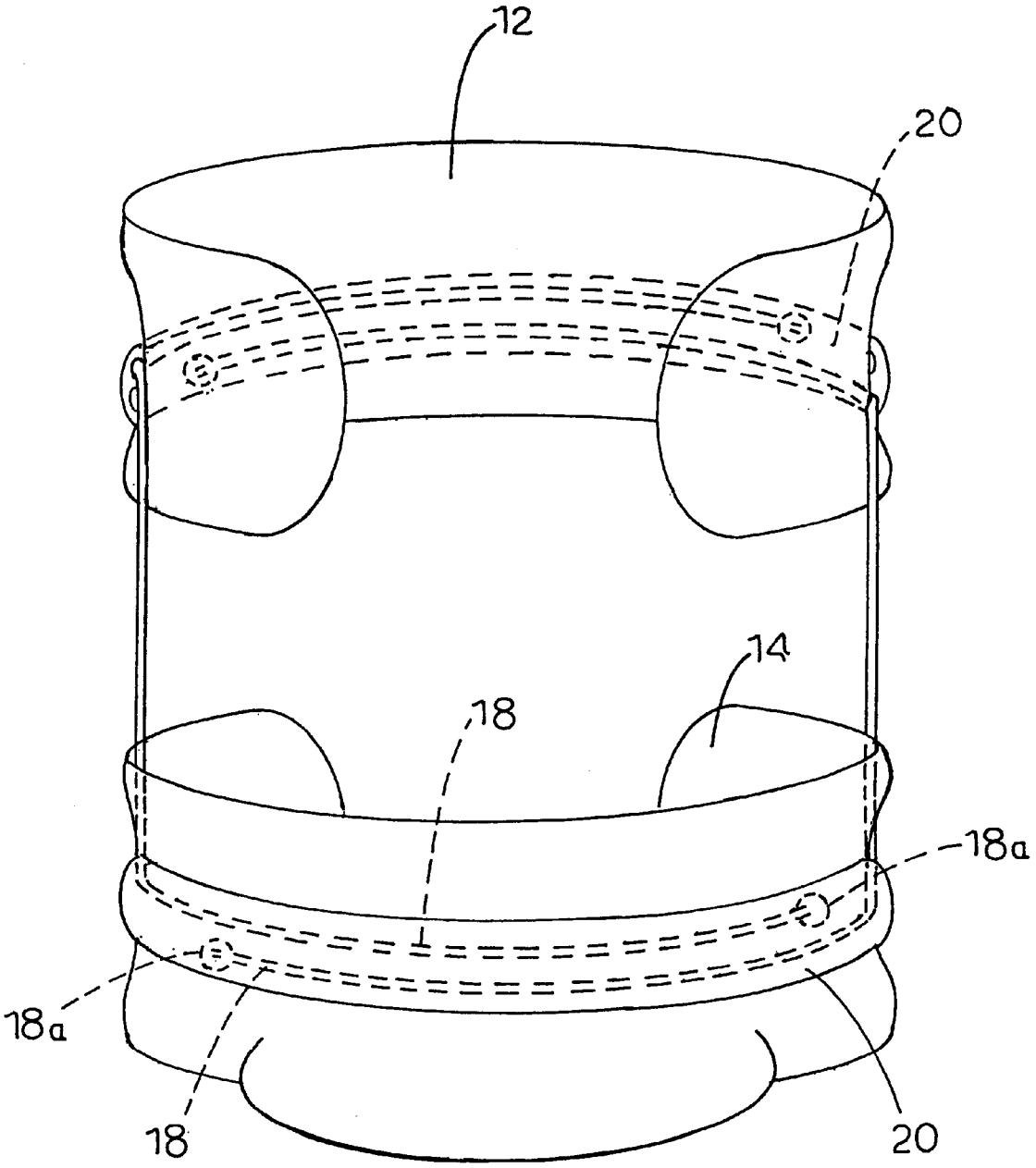
FIG. 1 is a perspective view showing the anti-abduction device of the present invention.

With further reference to the drawings, the anti-abduction device of the present invention is shown therein and indicated generally by the numeral 10. As will be appreciated from subsequent portions of this disclosure, the anti-abduction device of the present invention is designed and adapted to be worn about the arms of a child or other person. More particularly, in response to an abduction attempt, the person being accosted acts to locate an object and then extends his or her arms around the object after which the anti-abduction device 10 is interconnected between the arms so as to effectively secure the person about the object.

Viewing the anti-abduction device 10 in more detail, it is seen that the same includes a pair of bracelets indicated generally by the numerals 12 and 14. Each bracelet in the preferred embodiment is formed of a molded, generally flexible and durable plastic material and is designed to be worn about the arm of a child or other person. Each of the bracelets 12 and 14 include a band portion that extend in a generally circular fashion but wherein there is provided an opening formed within the band that enables the respective bracelets to be laterally inserted onto or removed from the arm of a person. In addition, the band portion of each bracelet includes a particular curvature. That is, as seen in the drawings, each bracelet includes an outer surrounding surface that assumes a generally concave shape. In addition, the inner portions of the bracelets 12 and 14 is configured and shaped so as to assume a generally convex shape. Thus it is appreciated that because of the general flexible nature of the bracelets 12 and 14 that these bracelets can be disposed one over the other in such a fashion that the two bracelets will be effectively connected or associated together.

One of the bracelets, bracelet 14, is provided with a lip 16. The lip 16 is formed about one edge of the bracelet 14 opposite the opening formed in the surrounding band of the bracelet. As will be appreciated from subsequent portions of this disclosure, the lip 16 assists the child or person in transferring bracelet 14 from one arm to another arm.

The two bracelets 12 and 14 are interconnected by an interconnecting structure. In the embodiment disclosed herein, there is provided a pair of flexible cables 18 that are interconnected between the bracelets 12 and 14. In the case of the present design, each of the cables 18 are designed to retract and extend with respect to at least one of the bracelets 12 and 14. To achieve this function, in a simple and effective way, the embodiment shown herein includes a pair of slip groves 20 formed in each bracelet 12 and 14. Each slip grove 20 functions to receive and hold a portion of each cable 18 and each cable is designed to slip or move through the slip groves. In the design shown herein, each flexible cable includes a pair of opposed stops 18*a* formed on opposite ends of the cable. Each cable, in a retracted position, extends through at least one of the slip groves 20 formed on a respective bracelet 12 or 14. The stops 18*a* retain the respective cables 18 within the slip groves so as to prevent the cables from becoming disconnected from the bracelets themselves. That is, where the cables exit the slip grooves 20, each cable passes through an opening or aperture that is smaller than the stop 18*a*. Thus the stop 18*a* is prevented from exiting the slip groove 20.

In a normal mode of use, the two bracelets 12 and 14 are worn about a single arm. In fact, bracelet 14 that includes the lip 16 is disposed or worn over the other bracelet 12. In this case, it is appreciated that the concave-convex shape enables the outer bracelet 14 to be effectively clipped or secured to the inner bracelet 12. In this mode, the respective cables 18 assume a generally retracted position within the bracelets. In the case of the embodiment shown in the drawings, the respective cables 18 are simply pushed or positioned within the slip groves 20 such that a substantial portion of the cables 18 are contained within the slip groves 20 of the respective bracelets 12 and 14. As will be appreciated from other portions of this disclosure, in this mode it is important for the lip 16 formed on the outer bracelet 14 to be positioned generally on the inner side of the arm. That is, the outer bracelet 14 is positioned such that the lip 16 faces the other arm. Therefore, it is appreciated that in a normal mode of operation, the two bracelets 12 and 14 are secured together and are worn in a concentric fashion about one arm.

The basic premise of the present invention is that abduction attempts directed at children and others can be prevented by frustrating the abduction within the very early periods of the abduction attempt. In the present case, the anti-abduction device 10 is designed to aid a child or person, that is under the threat of an abduction attempt, to tie him or herself to an object such as a lamp post, tree, or other structure. In the sequence of drawings illustrated in FIGS. 2–9, the object is illustrated as being a pole or upright structure and is indicated by the numeral 22.

Figure 2:
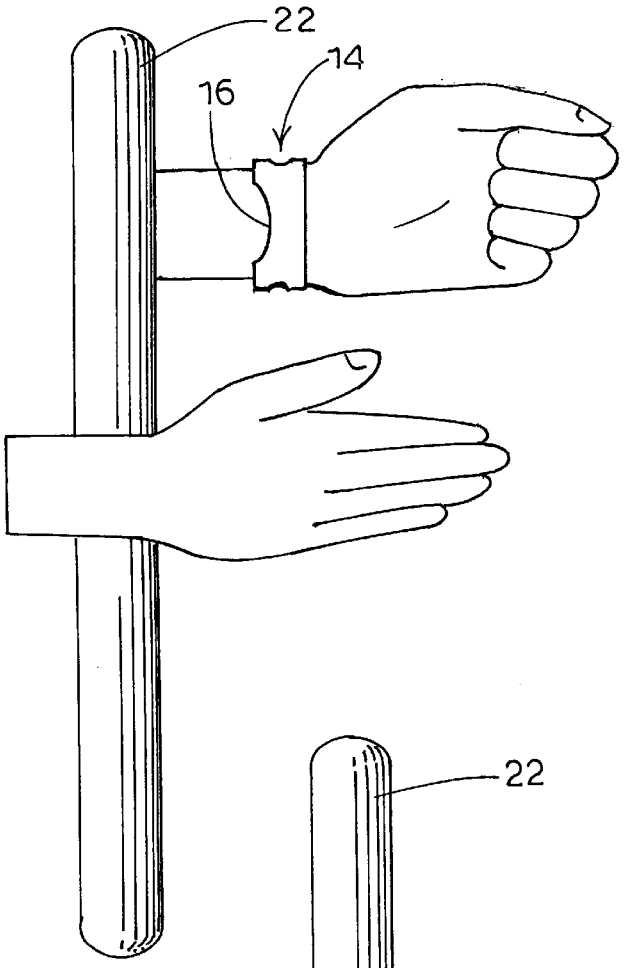
FIG. 2 illustrates a person having the anti-abduction device of the present invention worn on a single arm with the person extending his or her arms past an object.

In the case of an abduction attempt, the child or person identifies the object 22. As soon as this identification is made the child or person makes an effort to reach the object 22 and to extend both arms around the object as shown in FIG. 2. Note that the anti-abduction device 10 is being worn around the left arm about the wrist area. In particular, the bracelet 14 is snapped over and on to the inner bracelet 12 with the lip 16 of the outer bracelet 14 facing the other arm.

Figure 3:
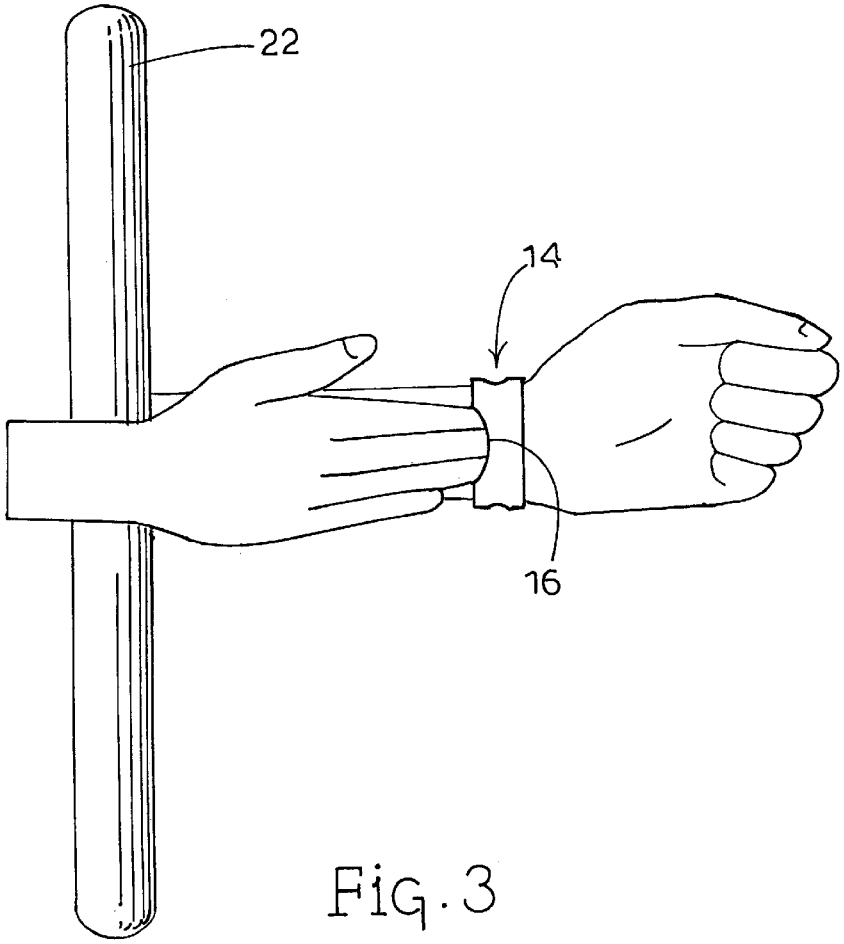
FIG. 3 illustrates the person extending one hand into the anti-abduction device.
Figure 4:
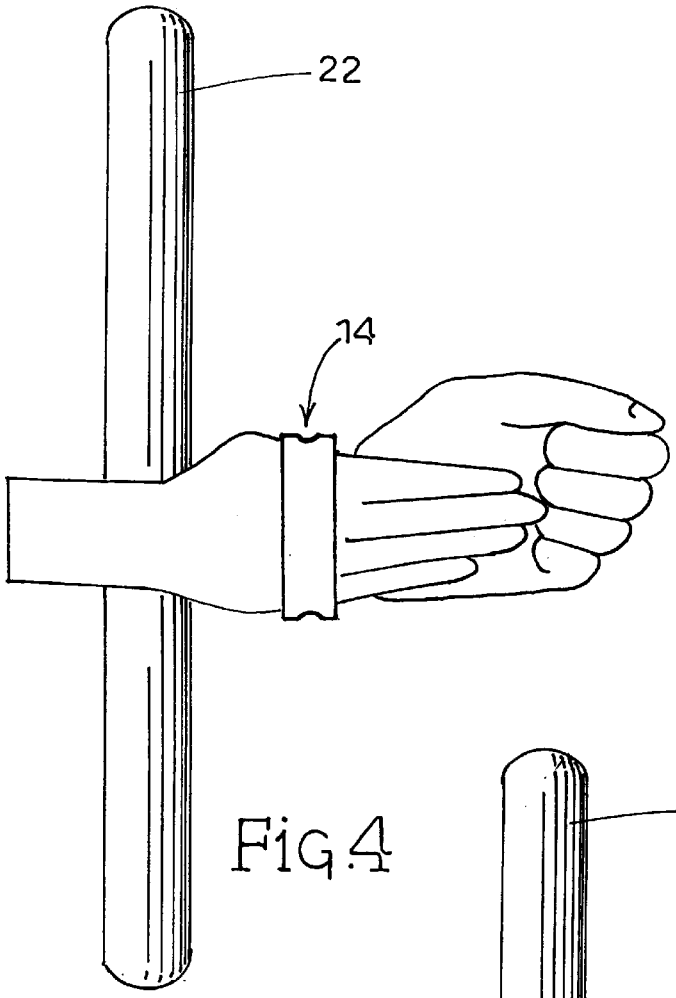
FIG. 4 illustrates the person extending that hand on through the anti-abduction device.

Once the arms have been extended around the object 22, then the right hand of the person is inserted under the lip 16 as shown in FIG. 3. The right hand is then further extended through the outer bracelet 14 and in the process the outer bracelet 14 is pulled or separated from the inner bracelet 12. See FIG. 4.

Figure 5:
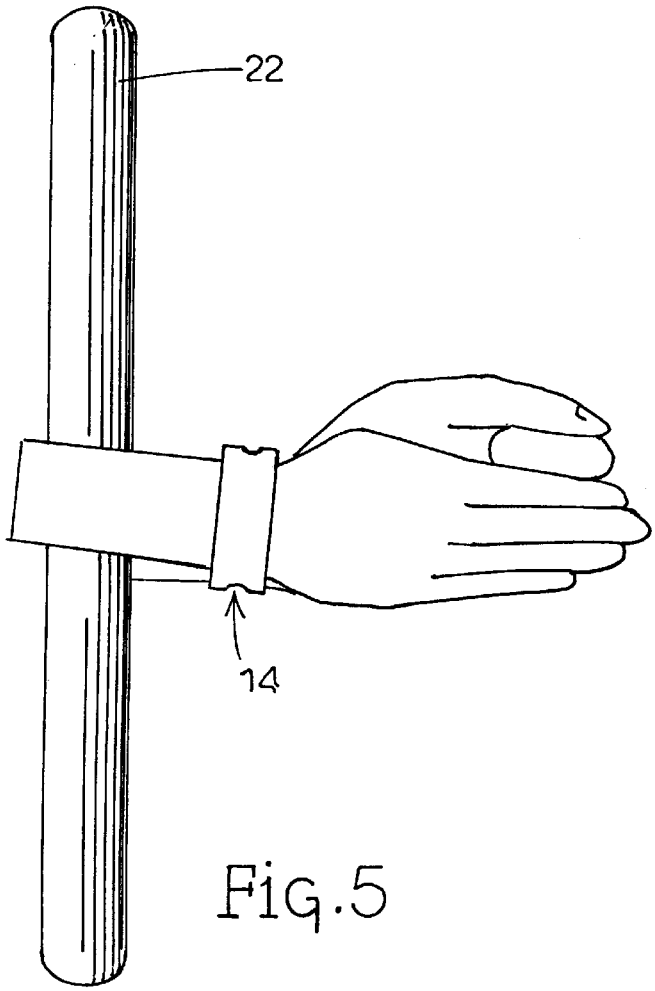
FIG. 5 illustrates the anti-abduction device extending around both arms of the person.
Figure 6:
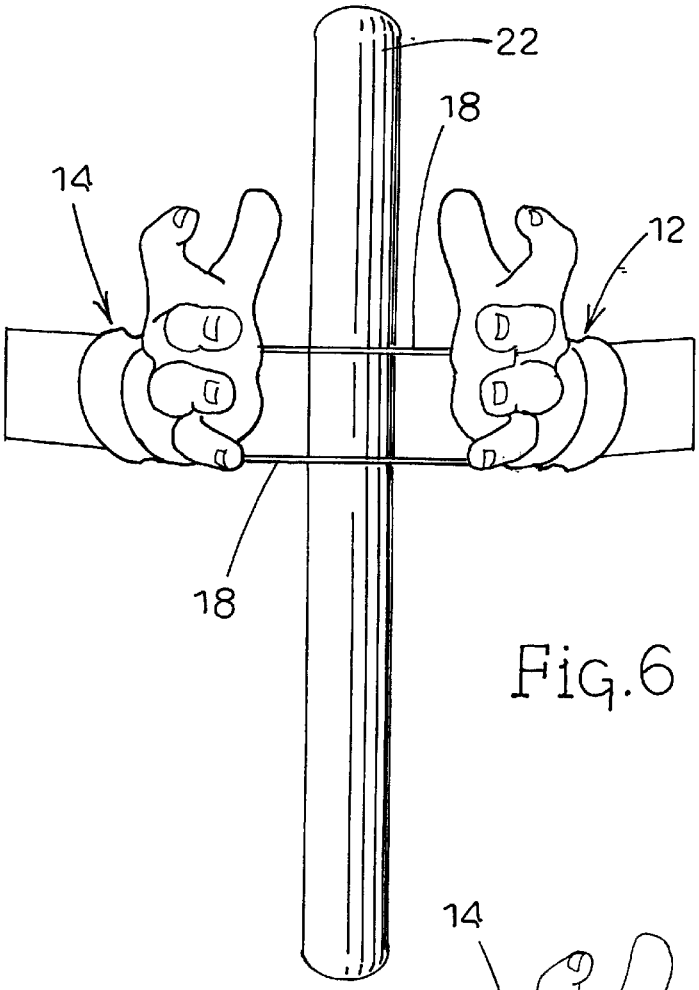
FIG. 6 is an end view showing the anti-abduction device and its interconnecting structure extending on one side of the object.
Figure 7:
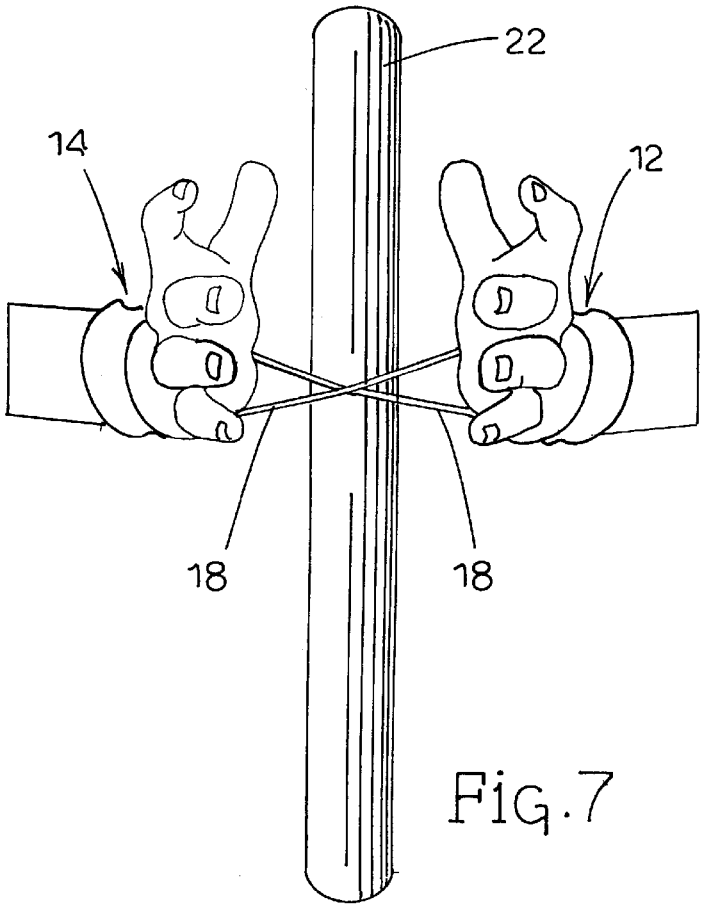
FIG. 7 is a view similar to FIG. 6, but wherein the interconnecting structure is crossed.
Figure 8:
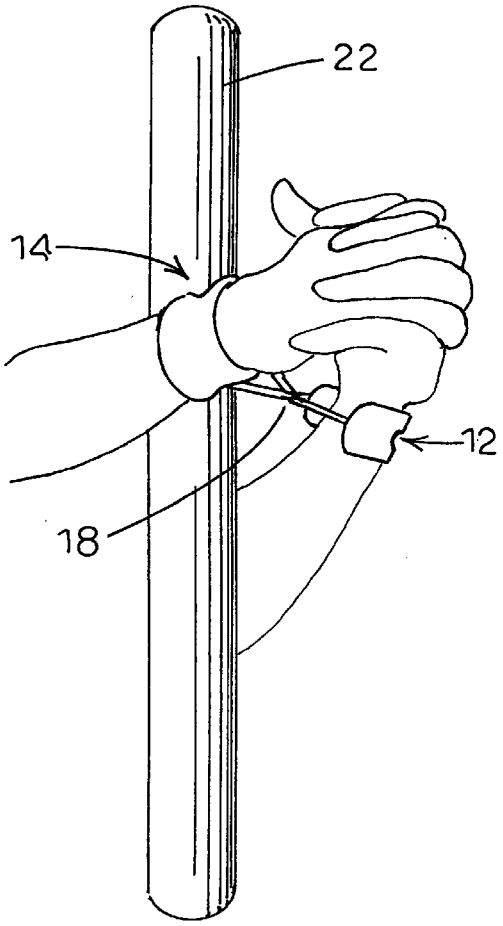
FIG. 8 is a perspective view illustrating the anti-abduction device secured to the arms of the person and effectively securing the person to the object.
Figure 9:
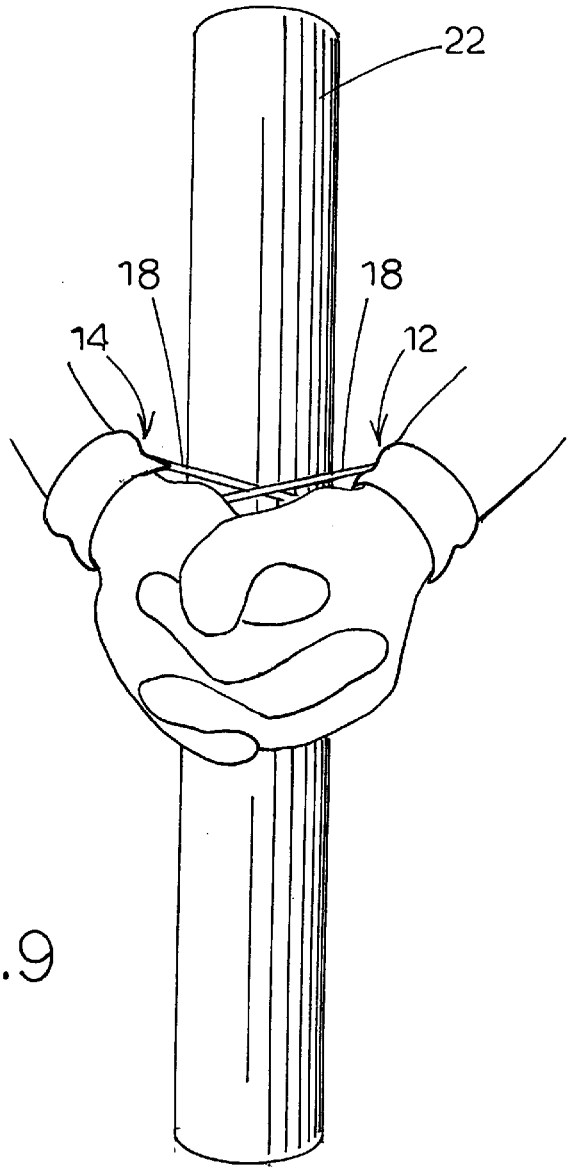
FIG. 9 is another perspective view of the anti-abduction device interconnected between the arms of a person such that the person is secured to the object.

Continuing to refer to the drawings and FIG. 5, the right hand is slipped entirely through the outer bracelet 14 such that the bracelet rests around the right arm of the person in the wrist area. In this process, the bracelets 12 and 14 are complete separated. As indicated in FIG. 6 this separation has resulted in the extension of the cables 18 that effectively interconnects bracelets 12 and 14 together. To make it more difficult to remove the bracelets 12 and 14 from the arms of the person, it is suggested that one hand be rotated through a 360 degree turn so as to create a cross configuration of the cables as shown in FIG. 5. This procedure twists and creates tension on the flexible cables 18.

Next the child or person clasps his or her hands together so as to tightly interlock the fingers and the thumbs. See FIG. 8. Immediately after clasping the hands together, the child or person pulls his or her hands towards the stationary object 22 and this has the affect of applying tension to the cables 18. Thus, the child or person is effectively tied or anchored to the object of 22 and this will have the effect of frustrating the criminal attempting to abduct the child or person.

The bracelets 12 and 14 can be formed in various sizes and because of the flexible nature of the plastic construction used in the preferred embodiment, the arm sizes of the bracelets can be adjusted by simply closing or opening the bracelets. While plastic may be a preferred or desirable material for the bracelets, other materials maybe used as well. In any event, it may be appropriate to line the inner surfaces of the bracelets 12 and 14 with a relatively soft material such as foam or cloth. This will avoid scrapping, scratching or chaffing the wrist.

As discussed above, the respective bracelets 12 and 14 are interconnected by one or more cable type device s. As used herein, the term cable means any flexible or pliable connectors such as a band, string, etc. Also in the preferred embodiment it is contemplated that the cable structure would assume the form of a plastic coated steel cable.

In this disclosure, the interconnecting structure shown is a pair of cables. But it will be appreciated that other types and forms of connectors can be used to interconnect, attach or lock the bracelets before or after the arms have been extended around the object. The cables illustrated herein are one example of suitable connecting means.

Also, the bracelets can be incorporated with identification information that may assist in the future location of abducted or lost children. This can be achieved by the purchaser of the anti-abduction device completing a form identification card with certain identification information such as name and phone number as well as the serial number of the particular anti-abduction device. This information can be returned and entered into a central database and stored. It is contemplated that the bracelets would be provided with a toll free phone number. A person finding the bracelets would call the toll free number and the parents of the lost child and/or police would be immediately contacted.

With reference to FIGS. 10–13, an alternate embodiment for the anti-abduction device 10 of the present invention is shown therein. In this case, the anti-abduction device 10 is shown in the form of a device that is worn on the arm of a person. As used herein, arm means any portion of the arm and includes hand, wrist and forearm. More particularly, the anti-abduction device 10 of this embodiment assumes the form of a bracelet or watch type device as in the preferred embodiment and the preferred use of the anti-abduction device, the device will be worn about the arm or wrist area of a person.

Viewing the anti-abduction device 10 in more detail, the same includes a central body indicated generally by the numeral 12. Extending from opposite sides of the central body 12 is a pair of fingers indicated generally by the numeral 14. Each of the fingers 14 extend from the central body 12 and generally curve around and grip the arm of a person. It is noted that in the embodiment illustrated herein, that the fingers 14 include terminal end portions that are spaced apart.

Viewing the central body 12 in more detail, it is seen that the same includes a base having a bottom 20 and a surrounding wall 22. Bottom 20 and the surrounding wall 22 define an open top cavity.

A rotating spindle, indicated generally by the numeral 24, is disposed within the cavity that is defined by the bottom 20 and surrounding wall 22. As will be appreciated from subsequent portions of this disclosure, the spindle 24 is designed to seat within the cavity and to rotate or spin under the influence of a coil spring 36 to be discussed hereafter. Viewing the spindle 24 in more detail, the same includes a bottom 26 and a circular wall 28. Formed adjacent and interiorly of the circular wall 28 is a spring catch 30 that as will be noted below functions to engage and connect the spindle 24 to a coil spring 36. The bottom 26 and surrounding circular wall 28 of the spindle 24 forms a spring seat or an area where the coil spring 36 is disposed.

One of the functions of the spindle 24 is to wind a flexible cable that is associated with the anti-abduction device 10. To achieve this, there is provided an annular hub 32 that projects downwardly from the bottom 26 of the spindle. The annular hub 32 includes a pair of transverse slots 34. As will be appreciated from subsequent portions of the disclosure, the transverse slots are particularly spaced such that a segment of the flexible cable can be inserted therein and securely attached to the spindle 24.

As referred to above, the coil spring 36 is designed to seat within the upper area of the spindle 24. Coil spring 36 includes an inner terminal end 38, and from the inner terminal end, the coil spring winds and coils outwardly therefrom. As such, coil spring 36 includes an outer coil segment that is referred to by the numeral 40. This outer coil segment includes an opening 42 that is sized to enable the spring catch 30 associated with the spindle 24 to project therethrough and to secure the spindle 24 to the outer coil segment 40 of the coil spring.

To house the coil spring 36 within the spindle 24, there is provided a cap indicated generally by the numeral 50 that is fixed atop the coil spring 36 and spindle 24. Projecting downwardly from the bottom of the cap 50 is a split cylinder 52 that includes a pair of transverse slots 54. The inner terminal end 38 of the coil spring 36 is projected through the transverse slots and because of the spacing of the slots and the thickness of the terminal end 38 of the coil spring 36, the terminal end of the coil spring is effectively secured to the split cylinder 52 projecting downwardly from the cap 50.

As discussed above, the anti-abduction device 10 of this embodiment assumes the form of a bracelet or article that simply surrounds at least a portion of the wrist of a person. In the case of the embodiment illustrated herein, the anti-abduction device 10 is designed with additional utility. More particularly, in the design shown in FIGS. 10–13 the anti-abduction device has incorporated therein a watch. As shown in the drawings, the anti-abduction device includes a watch module 60 that is disposed over the cap 50 and the underlying coil spring 36 and spindle 24. As illustrated in the drawings, the watch module 60 includes a watch unit 62 and an outer transparent face 64.

Secured to the spindle is a flexible cable indicated generally by the numeral 80 that extends from the spindle 24 around the fingers 14 of the anti-abduction device 10. More particularly, the flexible cable includes a segment 82 that extends through the transverse slots 34 of the annular hub 32 and is secured therein such that the cable does not slide or move linearly through the transverse slots 34. As shown in FIG. 12, the flexible cable 80 extending from the segment 82 coils around the annular hub 32 and then extends on opposite sides around the outer surfaces of the fingers 14. More particularly, the portion of the flexible cable 80 extending from the annular hub 32 forms a closed loop 84. Again this closed loop is that portion of the cable that extends from the annular hub around the fingers 14 of the anti-abduction device. It should be appreciated that the fingers 14 may be provided with apertures through which portions of the cable 80 are threaded. Thus in this case portions of the cable 80 extending along the fingers 14 would be housed or contained within such operation.

Figure 10:
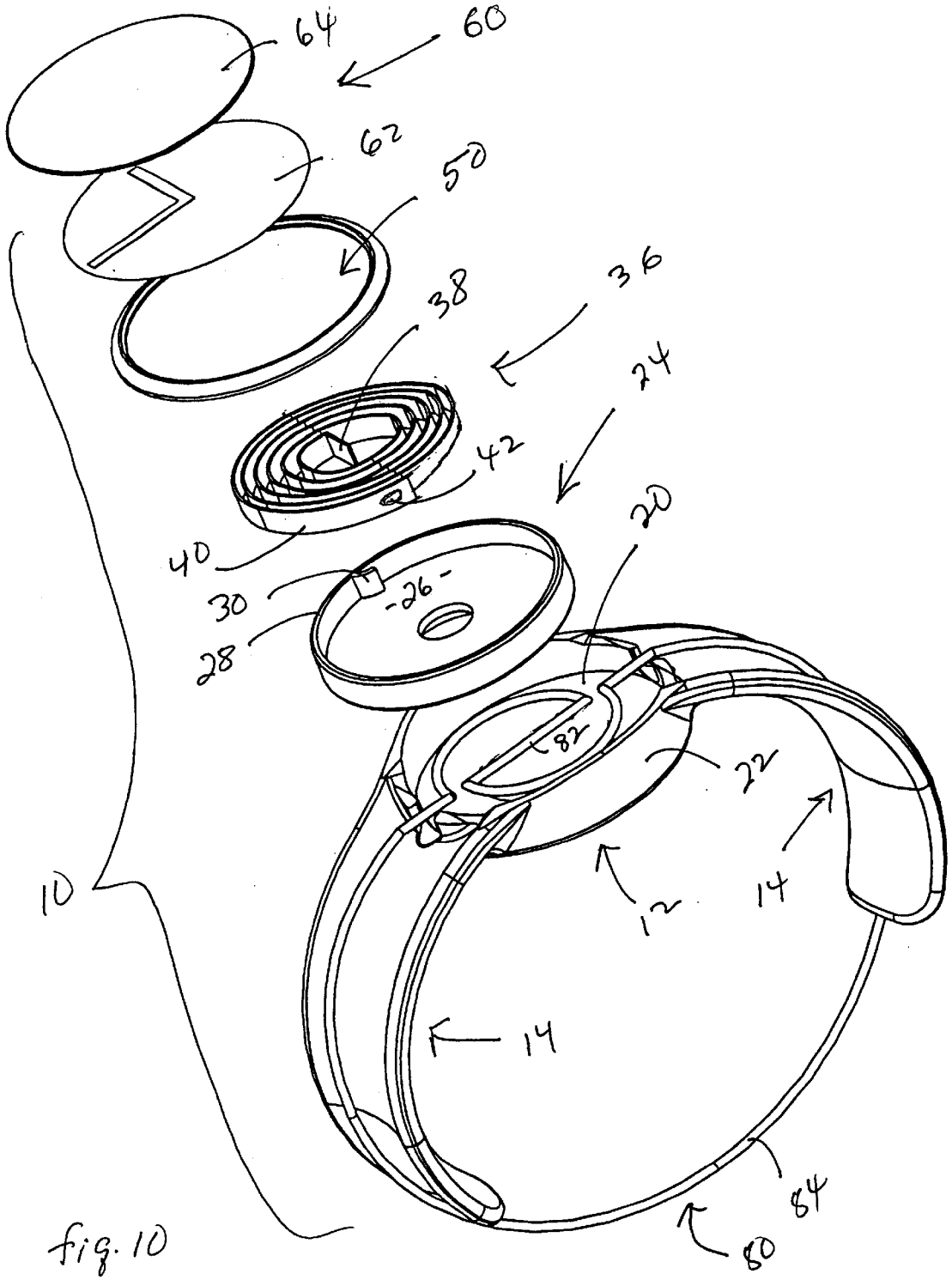
FIG. 10 is an exploded view of an alternate design for the anti-abduction device of the present invention.
Figure 11:
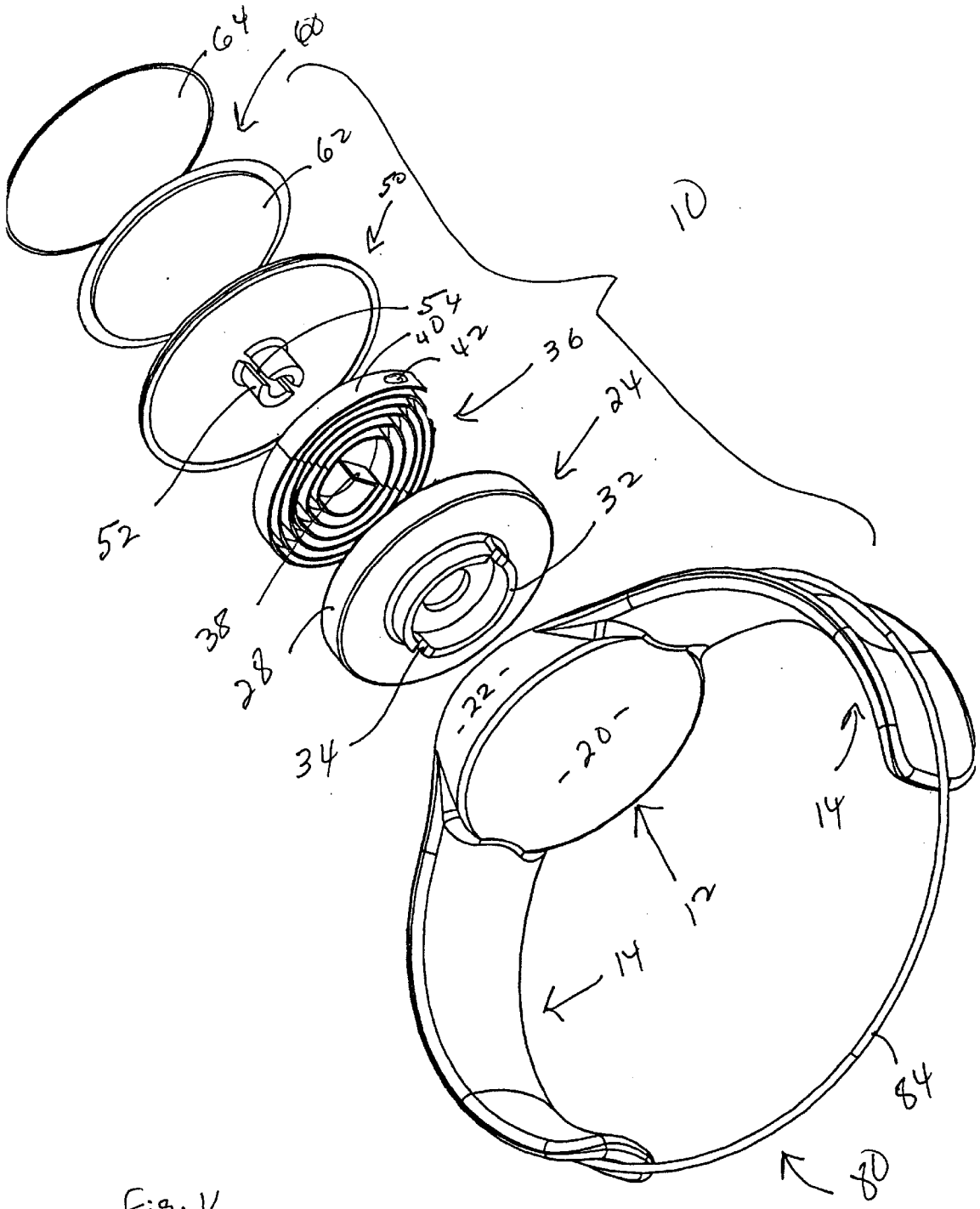
FIG. 11 is another exploded view of the anti-abduction device of FIG. 10 but shown from a different angle.
Figure 2:
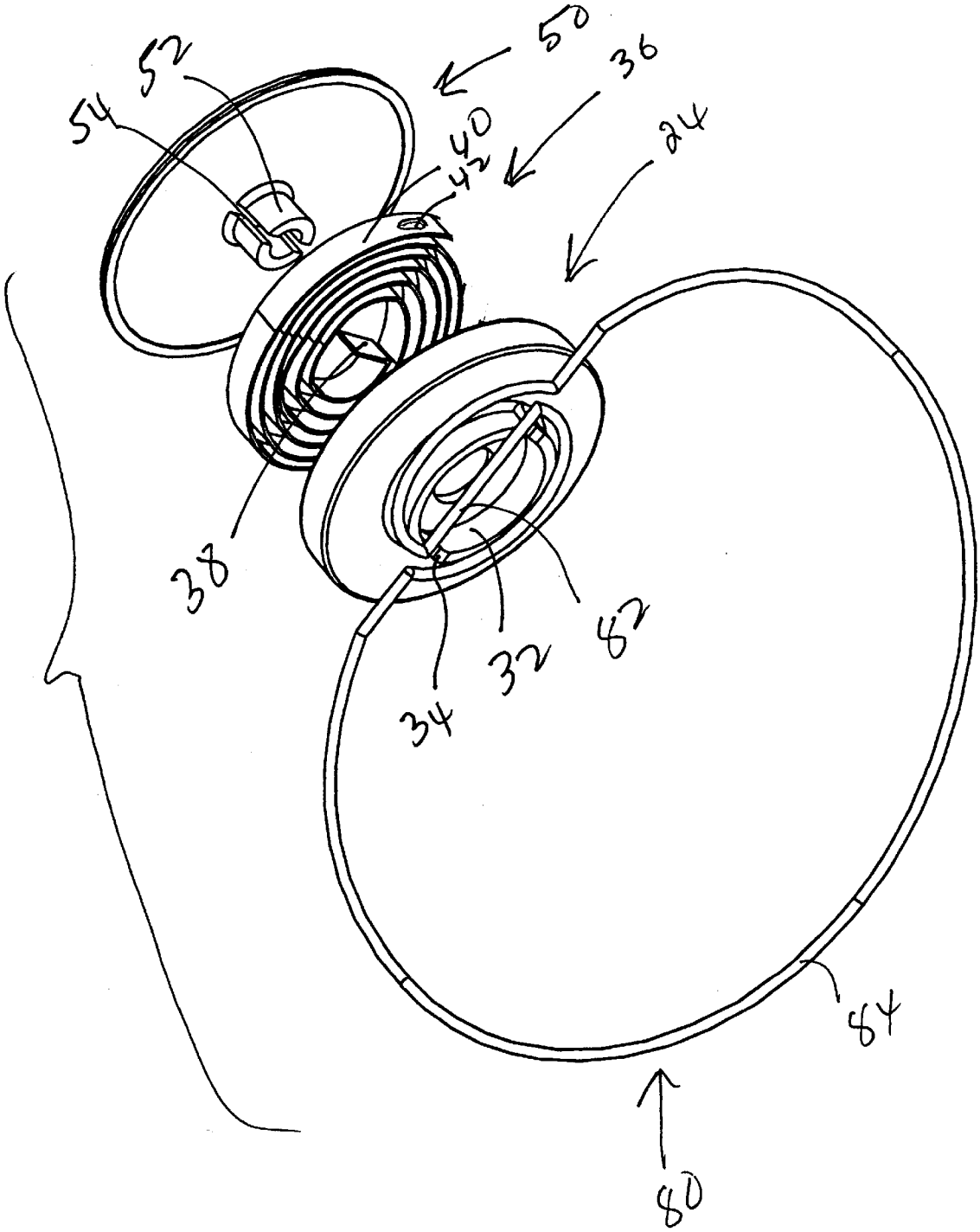
Figure 13:
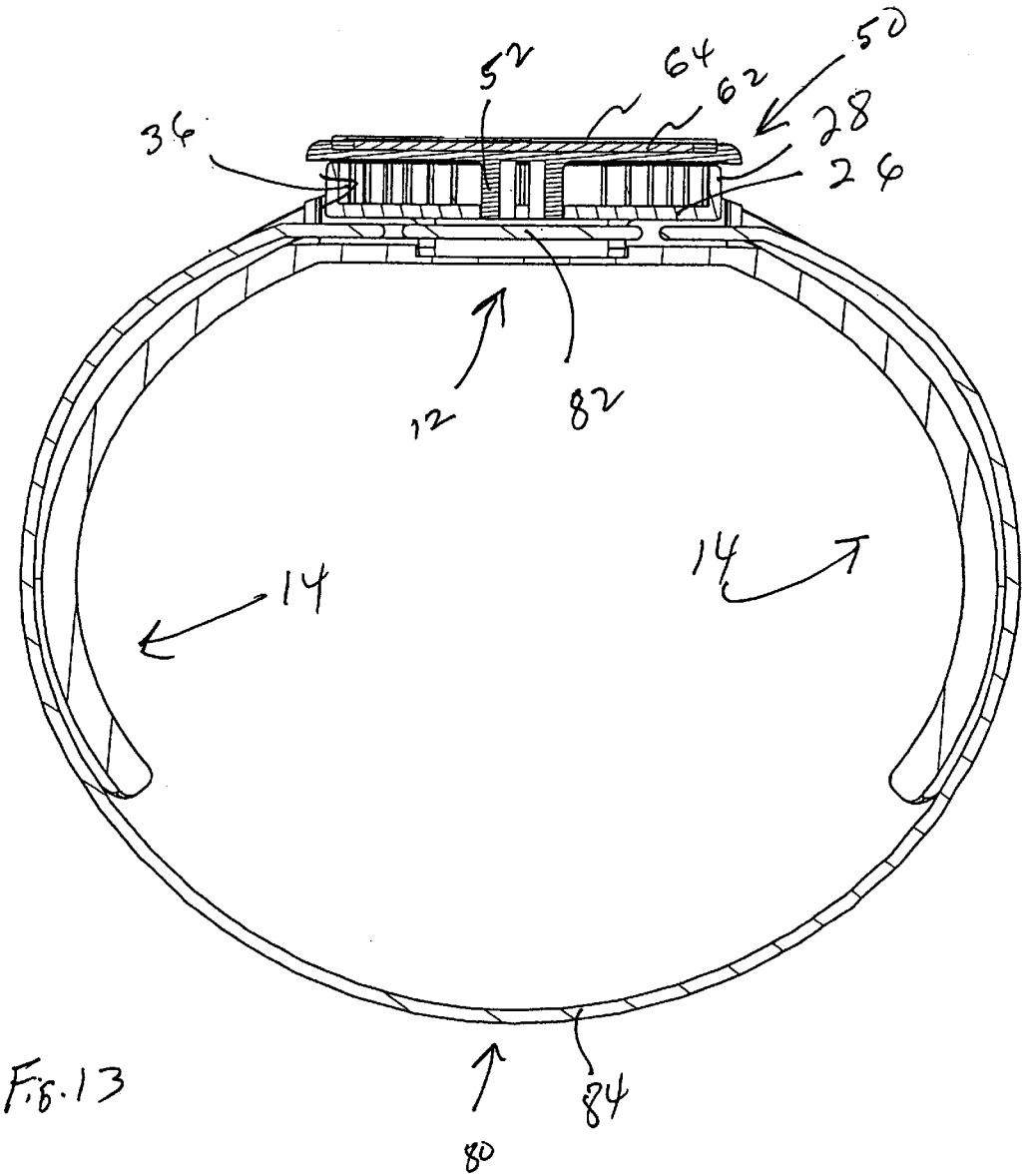
FIG. 13 is a cross sectional view of the anti-abduction device shown in FIGS. 10–12.

The flexible cable 80 normally assumes a retracted position. The retracted position is illustrated in FIGS. 10 and 11. In the retracted position, there is a segment of the flexible cable 80 wound around the annular hub 32 and essentially the remaining portion of the cable is maintained taunt around the fingers 14 and between the terminal ends of the fingers. In this position, the coil spring 36 assumes its expanded position also shown in FIG. 10. To extend the flexible cable 80, the portion of the cable extending between the terminal ends of the fingers 14 can be grasped and pulled. This will result in the wound portion of the cable or that portion of the cable extending around the annular hub 32 unwinding.

As the flexible cable 80 unwinds from around the annular hub 32, the spring catch 30 associated with the spindle 24 will cause the coil spring 36 to wind and in the process of winding the coil spring will compress, resulting in substantial stored energy within the coil spring. Thus, when the flexible cable is extended, the coil spring 36 will be wound tight and consequently when the cable is released then the energy of the coil spring 36 will rewind the cable and bring it back to its retracted or normal home position.

The anti-abduction device 10 of this embodiment functions in the essentially the same basic manner as the anti-abduction device of the first embodiment shown in FIG. 1.

In addition, the basic method illustrated in FIGS. 2–9 applies to this second embodiment as well. More particularly, the anti-abduction device 10 of the second embodiment (FIGS. 10–13) is worn about the wrist of a child or person. In the case of an abduction attempt, the child or person identifies an object nearby. As soon as the object is identified, the child or person extends both arms around the object in the same manner as shown in FIG. 2. Assume, for purposes of explanation, that the anti-abduction device of FIG. 10 is being worn around the left arm. Once the arms have been extended around the object, then the right hand of the person is inserted under the cable segment that extends between the terminal ends of the fingers 14. The right hand is extended completely under this cable segment and in the process this flexible cable 80 is extended to where a portion thereof extends around the right arm in a manner similar to that illustrated in FIG. 6. It is appreciated that in extending the cable 80, that the wound portion of the cable unwinds from the annular hub 32 and the spring 36 is wound so as to store energy. Consequently when the cable 80 is extended around the other arm, there is always some tension being applied to the cable. In other words, the coil spring 36, when the cable is extended, biases the cable 80 towards the retracted and normal position. In any event, once the cable 80 has been extended from the anti-abduction device 10 to where it extends around the other arm, then the basic method described with respect to the first embodiment (FIG. 1), applies equally as well to the second embodiment (FIGS. 10–13).

From the foregoing specification, it is appreciated that the anti-abduction device 10 of the present invention can be readily worn by a child or other person and that it does provide a practical and effective deterrent towards child abduction. Although the anti-abduction devices shown and disclosed herein have been discussed in the context of use by children, it should be appreciated that these devices can be used by a variety of people including women, teenagers and people of all ages.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of preventing and discouraging the abduction of children and other persons comprising: extending the arms of the person around an object and interconnecting the arms so as to effectively tie that person to the object.

2. The method of claim 1 wherein at least one member is secured to one arm of the person and wherein the member includes a cable that is extended from the member and operatively connected to the other arm while the object is surrounded by the arms of the person and the cable.

3. The method of claim 2 wherein the member includes a bracelet device.

4. The method of claim 2 wherein the cable is normally stored in a wound state within the member, but which is extendable from the member.

5. The method of claim 4 wherein the cable is spring biased towards the wound state but is extendable from the wound state such that the cable can be effectively connected to the other arm of the person.

6. The method of claim 2 including the step of winding the cable into a would configuration and maintaining the cable in the wound configuration by a biasing action, and selectively extending the cable by unwinding the cable such that the cable can extend between the two arms of the person and effectively connect the person to the object.

7. The method of clam 6 wherein the member includes a bracelet type device that includes a central body and two curved arms that extend around the arm and wherein in the wound configuration a portion of the cable is maintained in the central body of the bracelet while unwound portions of the cable extend around at least portions of the curved arms.

8. A method of preventing and discouraging the abduction of children and other persons comprising:

a. securing a device to one arm of the person;

b. extending the arms of the person at least partially around an object; and c. extending a cable from the device and connecting the cable to the other arm such that the object lies within the arms and the cable such that the cable effectively ties the person to the object.

9. The method of claim 8 wherein at least a portion of the cable is normally stored in a wound configuration within the device.

10. The method of claim 9 wherein the cable unwinds from the wound configuration in response to the cable being extended from the device.

11. The method of claim 10 wherein the device includes a coil spring that is operatively connected to a portion of the cable for biasing a portion of the cable towards the wound configuration, and wherein portions of the cable extend along a pair of curved fingers that extend around the arm of the person and wherein the fingers are spaced apart such that when the cable assumes the wound configuration a portion of the cable extends between the spaced apart fingers.

12. The method of claim 11 wherein the cable is extended from the device by extending the hand of the other arm underneath that portion of the cable that extends between the two fingers and pulling the cable from the device.

13. A device for being worn on the arm of a person comprising:

a. an arm encircling member that extends at least partially around the arm: and b. a flexible line associated with the arm encircling member and being extendable from a retracted position to an extended position.

14. The device of claim 13 wherein at least a portion of the flexible line is normally maintained in a wound configuration within the device.

15. The device of claim 14 wherein in the wound configuration the flexible line includes a loop segment that extends from the wound configuration.

16. The device of claim 13 wherein the arm encircling member includes a main body portion and an encircling structure that extends from the main body portion at least partially around the arm of the person; and wherein the main body includes a winding mechanism for engaging the flexible line and winding at least a portion of the flexible line into the wound configuration and wherein when in the wound configuration the flexible line includes portions that extend away from the wound configuration and adjacent the arm encircling structure.

17. The device of claim 16 wherein the winding mechanism includes a spring that is operative to wind at least a portion of the flexible line into the wound configuration but yet permits the flexible line to be extended during which time the flexible line unwinds from the wound configuration.

18. The device of claim 17 wherein the arm encircling structure includes a pair of fingers that extend from opposite sides of the main body portion of the device and wherein in each finger includes a cavity through which a portion of the flexible line extends and wherein the fingers include opposed terminal ends that are spaced apart and wherein when the flexible line assumes the wound retracted configuration, the flexible line extends between the terminal ends of the fingers.

19. A device for being worn on the arm of a person, comprising:

a. a bracelet comprising a central main body portion and an arm encircling structure extending from opposite sides of the main body portion for at least partially encircling the arm of a person;

b. a flexible line associated with said bracelet and being extendable from a retractable position to an extended position;

c. in the retracted position, the flexible line including a wound segment housed within the main body portion of the bracelet to form a wound configuration, and a loop position extending from the wound configuration and disposed adjacent the arm encircling structure extending from the main body portion of the bracelet;

d. a spring disposed within the main body portion and operatively connected to the flexible line for biasing the flexible line to the retractable position where a portion of the flexible line assumes the wound configuration within the main body of the bracelet; and e. wherein the flexible line is extended by pulling the loop portion of the flexible line that extends from the wound configuration and wherein the spring through its biasing action is operative to retract the flexible line and causes the flexible line to be wound into the wound configuration.

20. The device of claim 19 wherein the main body portion includes a spindle connected to the flexible line and a spring operatively connected to the spindle for rotating the same.

21. The device of claim 20 wherein the main body portion includes a base that receives and hold the spindle and wherein the wound portion of the flexible line is secured around an annular hub that projects downwardly from the spindle and which connects to the flexible line, and wherein the spindle includes a connector for connecting the spring to the spindle and wherein the spring is at least partially housed within the spindle.

22. The device of claim 21 wherein the spring is a coil spring and includes an inner terminal end that is generally fixed and wherein the spring includes an outer wound segment that includes an opening for connecting to the connector that connects the spindle to the spring.

23. An anti-abduction device for effectively securing a person to an object and inhibiting the abduction of the person, comprising:

a. a bracelet device for fitting around at least one arm of the person;

b. a flexible line associated with the bracelet device and extendable therefrom for connecting to the other arm such that the person can be effectively tied to the object by extending his or her arms around the object and then extending the flexible line from the bracelet device to the other arm and effectively surrounding the object with the arms and the flexible line interconnected between the arms.

* * * * *

US006263710C1

(12) REEXAMINATION CERTIFICATE (4789th)

United States Patent

Harris

(10) Number: US 6,263,710 C1

(45) Certificate Issued: *May 27, 2003

(54) ANTI-ABDUCTION DEVICE

(75) Inventor: Christopher L. Harris, Raleigh, NC (US)

(73) Assignee: Protective Solutions, LLC, Raleigh, NC (US)

Reexamination Request:
No. 90/006,205, Feb. 12, 2002

Reexamination Certificate for:

| | |
|---|---|
| Patent No.: | **6,263,710** |
| Issued: | **Jul. 24, 2001** |
| Appl. No.: | **09/448,710** |
| Filed: | **Nov. 24, 1999** |

( * ) Notice: This patent is subject to a terminal disclaimer.

Related U.S. Application Data

(63) Continuation-in-part of application No. 09/185,314, filed on Nov. 3, 1998, now Pat. No. 5,996,380.

(51) Int. Cl.[7] ..... E05B 75/00

(52) U.S. Cl. ..... 70/16; 128/878; 473/212; 119/856

(58) Field of Search ..... 70/15–17; 24/16 PB; 119/770, 792, 810, 811, 816, 817, 856, 857; 473/212, 213, 447, 448, 450; 602/16, 21, 63; 482/74, 116, 124

(56) References Cited

U.S. PATENT DOCUMENTS

| | | | | | |
|---|---|---|---|---|---|
| 3,007,331 | A | * | 11/1961 | Irwin | 70/16 |
| 4,024,736 | A | * | 5/1977 | De Michieli | 70/16 |
| 5,807,218 | A | * | 9/1998 | Nagatomo | 482/124 |
| 5,894,748 | A | * | 4/1999 | Capperrune | 70/16 |

OTHER PUBLICATIONS

Earth First!, Backwoods Direct Action!, http://headwaters–ef.enviroweb.org/backwoods.html.*

Ehrentreu, Rachel, "Disoriented," Copyrighted Aug. 12, 1997. http://members.nbci.com/EXEC/stories/dg/DISORIO9.TXT.*

* cited by examiner

*Primary Examiner*—Lloyd A. Gall

(57) ABSTRACT

An anti-abduction device for preventing or discouraging the unlawful abduction of a child or person. The anti-abduction device comprises a pair of bracelets with each bracelet being adapted to fit around the arm of a person. More particularly, the bracelets include an interconnecting structure that enables the bracelets to be interconnected. In use the bracelets are disposed about the arms of a child or person. In an abduction threat the child or person places his or her arms around an object. Because the bracelets assume an interconnected mode after the arms have been extended around the object, it follows that the child or person is effectively tied to the object and this will serve to frustrate the abduction attempt.

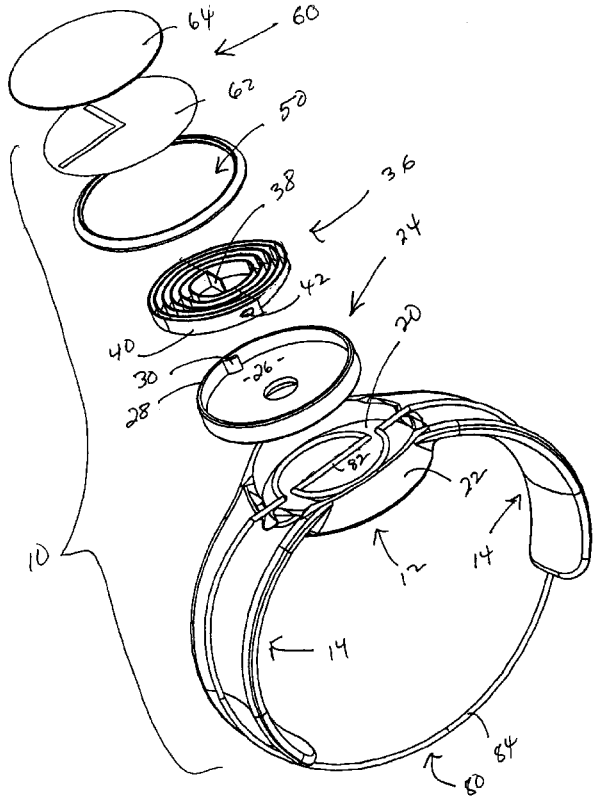

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 4–12 and 16–22 is confirmed.

Claims 1–3, 13–15 and 23 are cancelled.

* * * * *